United States Patent [19]

Marhold et al.

[11] Patent Number: 4,479,038

[45] Date of Patent: Oct. 23, 1984

[54] MODE CONDITIONED JOYSTICK CONTROL FOR VIDEO GAMES

[75] Inventors: Werner Marhold; Danny J. Pool, both of Bishop, Calif.

[73] Assignee: Cal-Tron Corporation, Bishop, Calif.

[21] Appl. No.: 446,508

[22] Filed: Feb. 11, 1983

[51] Int. Cl.[3] ..... H01H 25/00

[52] U.S. Cl. ..... 200/6 A; 200/153 K

[58] Field of Search ..... 200/5 R, 6 A, 17 R, 200/18, 153 K

[56] References Cited

U.S. PATENT DOCUMENTS

| | | | |
|---|---|---|---|
| 3,005,055 | 10/1961 | Mattke | 200/6 A X |
| 3,708,636 | 1/1973 | Sobchak | 200/6 A |
| 4,181,827 | 1/1980 | Diepeveen | 200/6 A |

FOREIGN PATENT DOCUMENTS

| | | | |
|---|---|---|---|
| 518116 | 2/1940 | United Kingdom | 200/6 A |
| 605380 | 7/1948 | United Kingdom | 200/6 A |

*Primary Examiner*—J. R. Scott

*Attorney, Agent, or Firm*—William H. Maxwell

[57] ABSTRACT

A joystick for restricted movement about X and Y axes to actuate opposed switches disposed in pairs of said axes and operable in an eight-way mode to actuate adjacent corner switches as well as single axially aligned switches, and operable in a four-way mode to actuate only single axially aligned switches, with a selectively positionable gate controlling the mode of operation, all of which is embodied in a spring biased assembly characterized by a tilting flange captured in a complementary mounting plate socket.

25 Claims, 13 Drawing Figures

(Eight-Way Mode)

(Four-Way Mode)

MODE CONDITIONED JOYSTICK CONTROL FOR VIDEO GAMES

BACKGROUND OF THE INVENTION

This invention has to do with video games and the like where control of a cathode-ray tube display is by means of a "joystick". Generally, joysticks of the type under consideration move about X-Y axes to govern complementary display co-ordinates on a display screen. Control is by electrical contacts opened or closed by movement of the joystick about said X-Y axes to operate any one of four pairs of switch contacts, or simply to operate any one of four separate switches. A four-way switching arrangement in which there are four distinct switching conditions is one in which only one of four switches is operable at a time. However, there are situations in addition to the foregoing four switching conditions where adjacent switches on axes X and Y are simultaneously operable, in which case there are eight distinct switching conditions, and this being an eight-way switching arrangement. It is a general object of this invention to provide for mode changes in a video game joystick, by the use of a selectively positioned gate that restricts movement of the joystick and switch operation according to the mode desired, for example the aforesaid four-way or eight-way switching modes as circumstances require.

Video game joysticks are subject to abuse and must be durably constructed in order to be reliable in operation. Heretofore, joysticks of the type under consideration have been operable on X-Y axes by rather complicated means subject to damage when abused. A main consideration is the operation of switch contacts, and to this end limits of movement of said X-Y axes are required, and this feature also must be reliable and durable. Accordingly, it is an object of this invention to provide a durable restriction to X-Y axis movement of a joystick, avoiding complications and with increased reliability. With the present invention, there is a minimum number of parts and each is of a simple easily fabricated configuration.

The restrictive movement of the joystick is also controlled by the present invention to operate in either of the aforementioned four-way and eight-way modes of operation. To this end it is an object of this invention to provide selective gating by which the desired mode can be established. In practice, there is an eight-way mode determined by a first rotative position of a control gate, and there is a four-way mode determined by a second rotative position of the control gate. By installing the joystick unit with the gate selectively conditioned, the desired mode of operation is established.

Heretofore, the typical joysticks of the type referred to above have been gimbaled in right angularly related yokes supported upon axis pins, one yoke within the other, and stops for limited movement applied in a surrounding cage. It is an object of this invention to eliminate angular yokes, supporting gimbal pins, cages and the like, and to rely entirely upon the joystick and support plate configurations having inherent movement limits. With the present invention, there is a single movement limiting element for retainment of the joystick in working position biased by a single compression spring. The joystick is a straight member that can freely rotate, and that operates the switch contacts through a concentric cam which serves as a spring seat held in place by a single snap ring or clip. Relatively rotatable gates surround the joystick and selectively control its mode of operation, either four-way or eight-way as desired.

SUMMARY OF THE INVENTION

This invention relates to video game joysticks that actuate switches disposed oppositely on X and Y axes, for example fore-and-aft, and side-to-side or transverse axes. In practice, there is a normally centered switching cam adapted to be displaced by manipulation of the joystick to engage the switches, the switches being disposed diametrically opposite and normally spaced from the periphery of the cam along respective axes. Accordingly, there are four switches spaced 90° apart and with the contact elements thereof spaced from the periphery of the cam when it is centered, the cam being laterally displacable to engage any one or two adjacent contact elements. In practice, leaf switches are employed with right angularly related contact elements as shown, so that cam displacement along either axis X or Y engages a single contact element, and so that diagonal cam displacement engages two adjacent right angularly related contact elements. The joystick is yieldingly biased into a centered and erect position by a compression spring seated in the cam, and it projects through a restrictive opening in a mounting plate. A feature is mode control by means of selectively positionable gates for operation as a four-way or eight-way unit.

The foregoing and other various objects and features of this invention will be apparent and fully understood from the following detailed description of the typical preferred forms and applications thereof, throughout which description reference is made to the accompanying drawings.

PREFERRED EMBODIMENT

Figure 1:
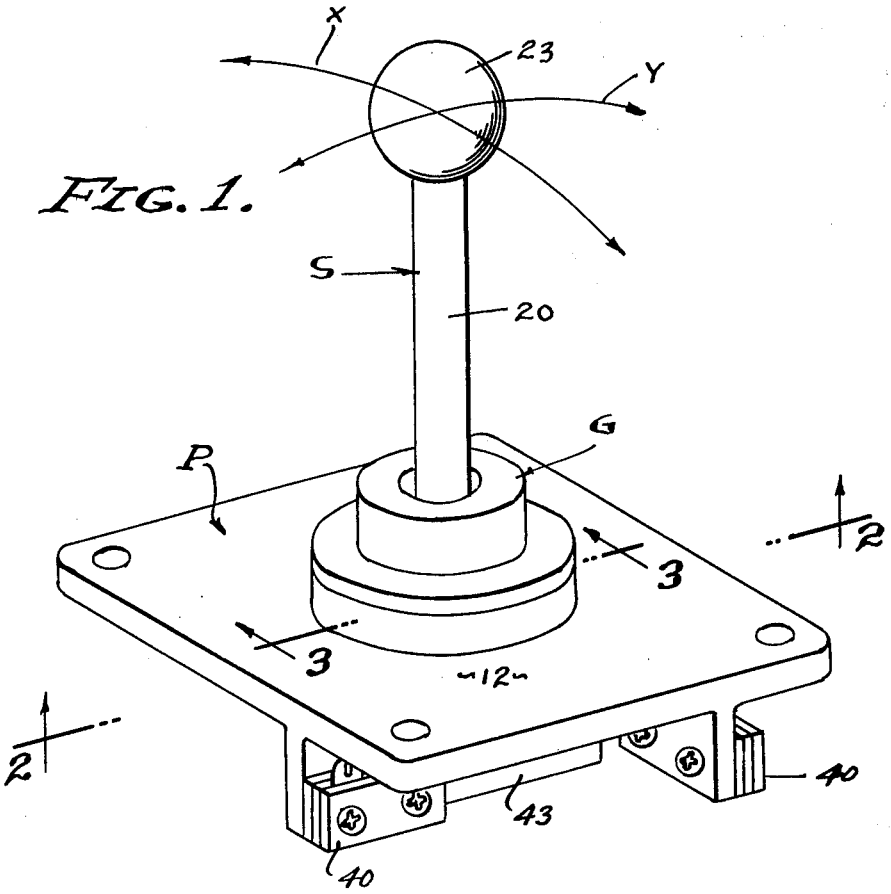
FIG. 1 is a perspective view of a joystick control embodying the features of the present invention.

The joystick S of the present invention is capable of motion in two or more directions, and operates by a fore-and-aft motion along an axis X and by, a side-to-side motion along an axis Y. Ninety degree X and Y motions of joystick S are effective for video game switching in a four-way mode, while intermediate angular motions between said axes are additionally effective in an eight-way mode. In either case the joystick S can be moved through all the aforesaid positions, however the effect thereof is controlled by the gates hereinafter described. That is, the switch contact engagement by the joystick S is selectively controlled for at least two distinct modes of operation. Generally, the joystick control unit as it is disclosed herein involves a mounting plate P in which there is a socket 10 that receives a flange 11 for restricted movement of the joystick carried thereby, there is a centering spring means 29 seated in a switching cam 30, and there is a retainer 34 securing the assembly together as a unit.

The mounting plate P is a flat frame-like base 12 of square configuration adapted to be mounted to the underside of the control deck in a video game machine (not shown). Accordingly, there are corner openings for mounting screws. Alternately, it is contemplated that a housing (not shown) underly the mounting plate as a part thereof or as a separate member, to enclose the switches and/or to mount the same, and also to carry a motion controlling gate as later described. The center portion of the base 12 is open for the movement therethrough of the joystick S with clearance, there being a stepped bore with an upwardly faced shoulder 13 for support of the joystick S. The lower portion 14 of said bore is stepped inwardly and is of right cylinder form to freely pass the stem of the manipulatable joystick, regardless of its position. The upper portion of said bore is stepped outwardly and its inner portion 15 at the shoulder 13 is of right cylinder form while its outer portion 16 is conical, upwardly divergent, for mode control as later described. The outer opening side of the stepped bore is closed by control gates G or G1 and G2 as will be described, leaving the interior of said bore of sufficient height to permit tilting of the position limiting flange 11.

The joystick S is a straight elongated member separated into upper and lower legs 20 and 21 by the flange 11, all of which can be integral. Preferably, the flange 11 is a separate part in which case the legs 20 and 21 are separated by a step 22 faced downwardly to position the flange 11. Accordingly, the lower leg 21 is of the smaller diameter to freely pass through the lower portion 14 of the stepped bore in the base 12. As shown, the leg 20 is a straight cylindrical rod that extends well above the top of the base 12 where it carries a ball 23 by which it is grasped for manipulation. The leg 21 extends below the bottom of the base 12 where it carries the switching cam 30. Essentially, the leg 20 is a manually operable lever and the leg 21 is a switch actuating lever.

Figure 3:
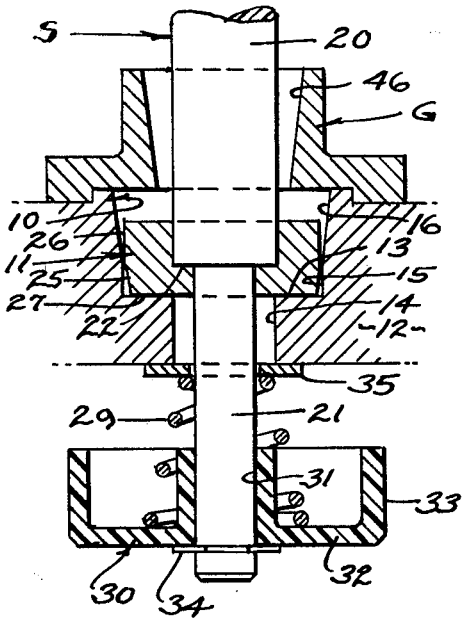
FIG. 3 is an enlarged fragmentary sectional view taken as indicated by line 3—3 on FIG. 1.
Figure 4:
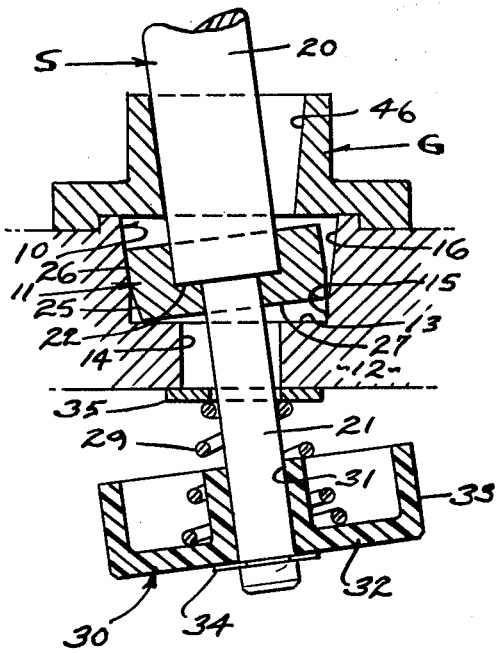
FIG. 4 is a view similar to FIG. 3 showing a displaced position of the joystick.
Figure 5:
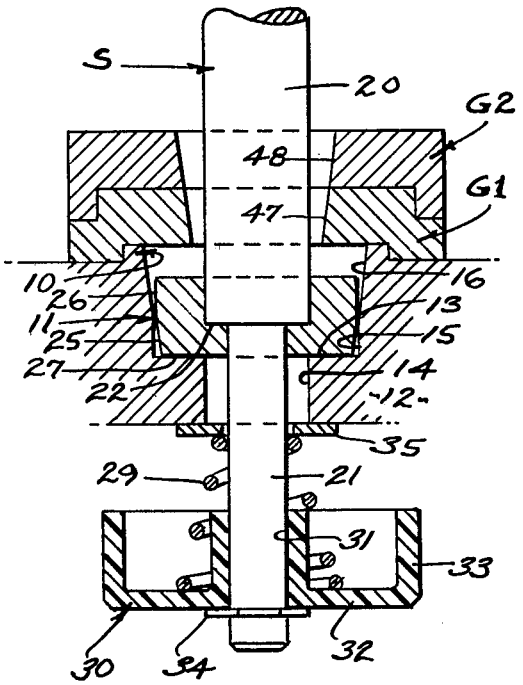
FIG. 5 is a view similar to FIG. 3 and shows the addition of a control gate thereto.
Figure 6:
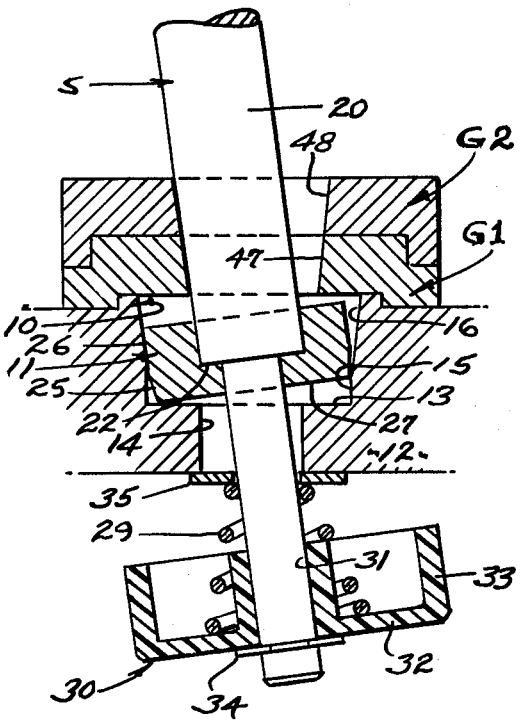
FIG. 6 is a view similar to FIG. 5 showing a displaced position of the joystick.
Figure 7:
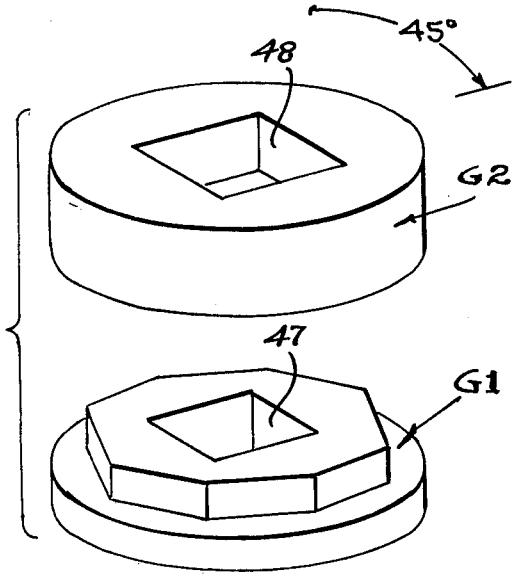
FIG. 7 is an exploded perspective view showing the gate elements positioned to establish an eight-way mode of operation.
Figure 9:
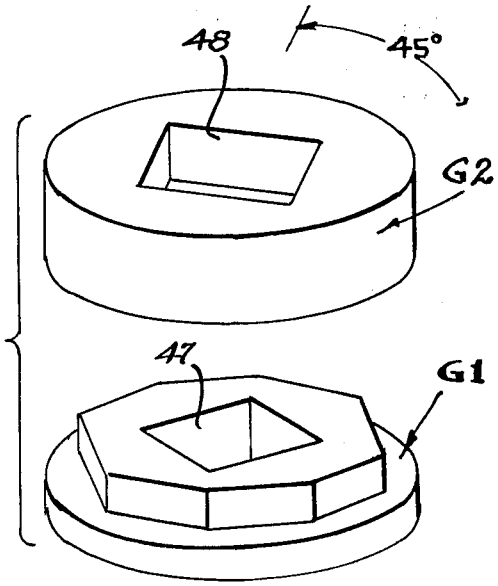
FIG. 9 is an exploded perspective view similar to FIG. 7 showing a displaced position of the gate elements to establish a four-way mode of operation.
Figure 8:
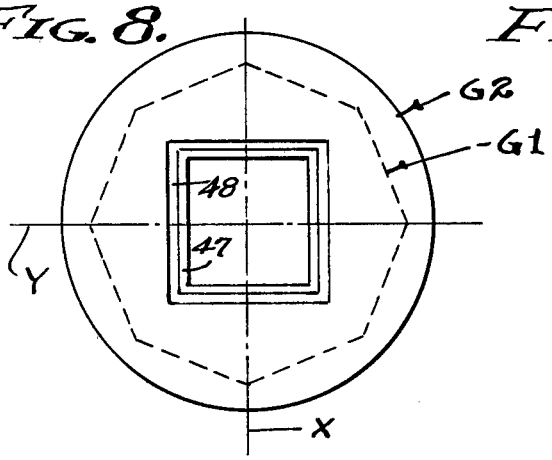
FIG. 8 is a plan view thereof.
Figure 10:
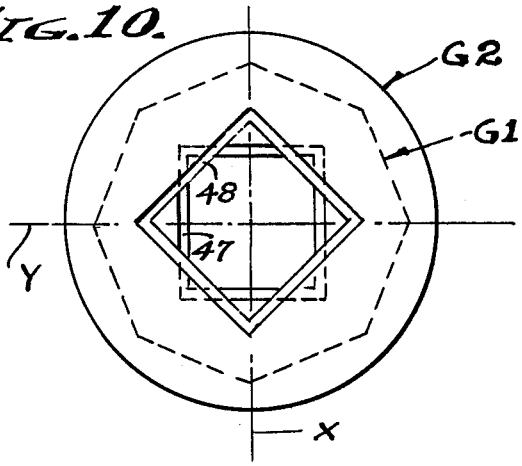
FIG. 10 is a plan view thereof.

The flange 11 restricts and/or limits displaced movement of the joystick S and is characterized by an enlargement of or a part applied to the joystick at the joinder of the legs 20 and 21 thereof. The flange 11 is shown as a separate part slideably engaged over the lower leg 21 and seated on the step 22 to substantially occupy the outwardly stepped portion of the bore in the base 12. In accordance with this invention, the flange 11 has restricted movement within the confines of inner portion 15 and outer portion 16 of said stepped bore. Accordingly, the inner portion 25 of the flange 11 is conically tapered, downwardly and inwardly, from the outer right cylinder portion 26 thereof, while the bottom face 27 thereof is flat and in a plane normal to the axis of the joystick S. As shown in FIG. 4, the movement limit of angular displacement is restricted when the periphery of the outer cylinder portion 26 of flange 11 engages the conical outer portion 16 of the stepped bore in the base 12. The conical inner portion 25 of the flange permits this tilted displacement of the flange, stopped as shown. It will be observed that the joinder of the cone and cylinder portions of the socket 10 and flange 11 lie in a common plane when the joystick S is centered as shown in FIG. 3.

The switching cam 30 is a circular member carried by the lower leg 21, in spaced relation to the bottom of the base 12. The cam 30 has a bore 31 slideably engaged over the leg 21, and has a disc 32 disposed normal to the axis of the joystick. The snap ring retainer 34 engages the bottom side of disc 32 to secure the assembly, with the concentric rim 33 of the cam disposed within the switch contacts next described. Tightness of the assembly and yielding bias of the joystick to a centered position is by the compression spring means 29 seated between the base 12 and the cam 30. As shown, the spring is conical as it tapers inwardly to the leg 21 where it seats against a washer 35 that slides against the base as shown. The spring means 29 can also be a straight cylindrical spring coil seated directly on the base 12.

A common arrangement of switches in a video game controller of the type under consideration is the diametrical placement of a pair of switches on each axis X and Y. Accordingly, fore-and-aft motion will alternately actuate one of a pair of switches, and side-to-side motion will alternately actuate one of the other pair of switches. In practice, leaf type switches are employed as shown, carried by insulating blocks 40 fastened to depending struts 41 so that an inner leaf 42 thereof is normally spaced from the periphery of switching cam 30 to be tangentially engaged thereby when the cam is displaced to close said space and depress said leaf. Alternately, the switches are carried by the depending walls of the aforementioned housing (not shown). The inner leaves of the four switches are right angularly related forming a square surrounding cam 30, and so that diagonal displacement of cam 30 will actuate adjacent switches in an eight-way mode. It is an object of this invention to limit this diagonal cam movement and thereby condition the device for a four-way mode whereby a single switch is actuated at a time.

Figure 2:
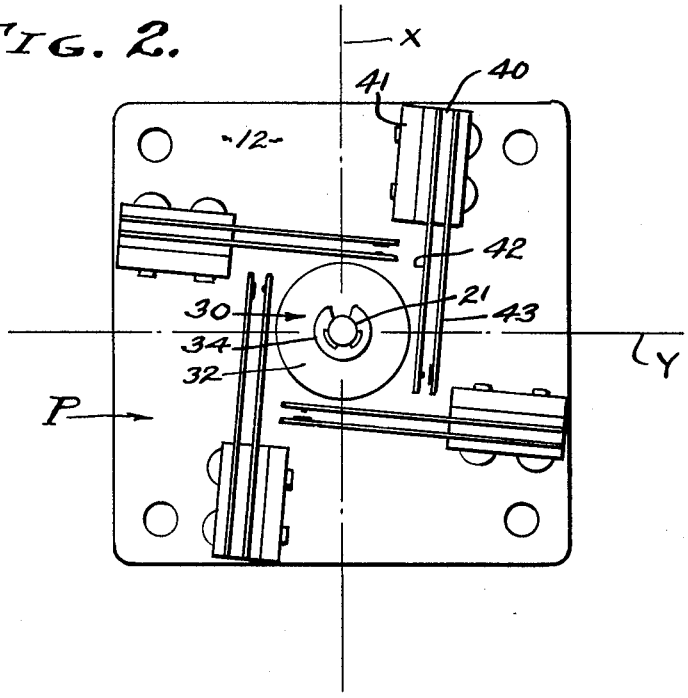
FIG. 2 is a bottom view taken as indicated by line 2—2 on FIG. 1.
Figure 11:
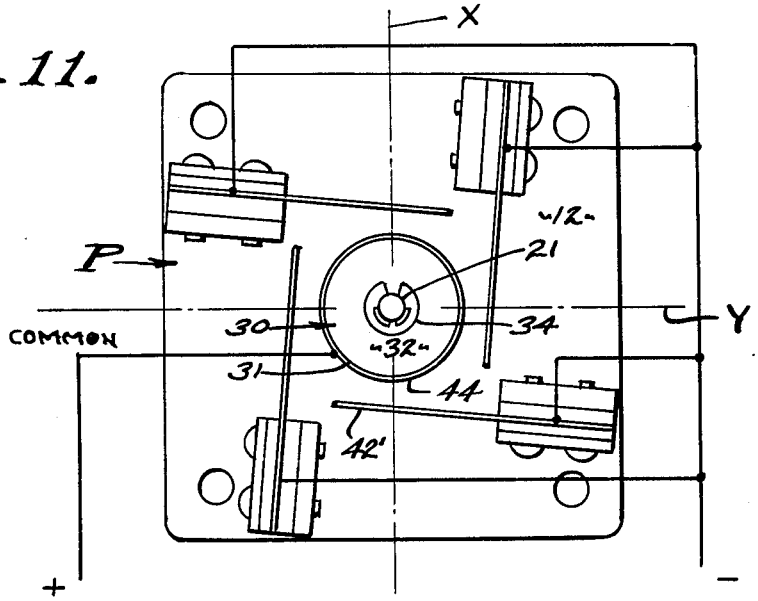
FIG. 11 is a bottom view similar to FIG. 2 and shows a modified form of common switch contact.
Figure 12:
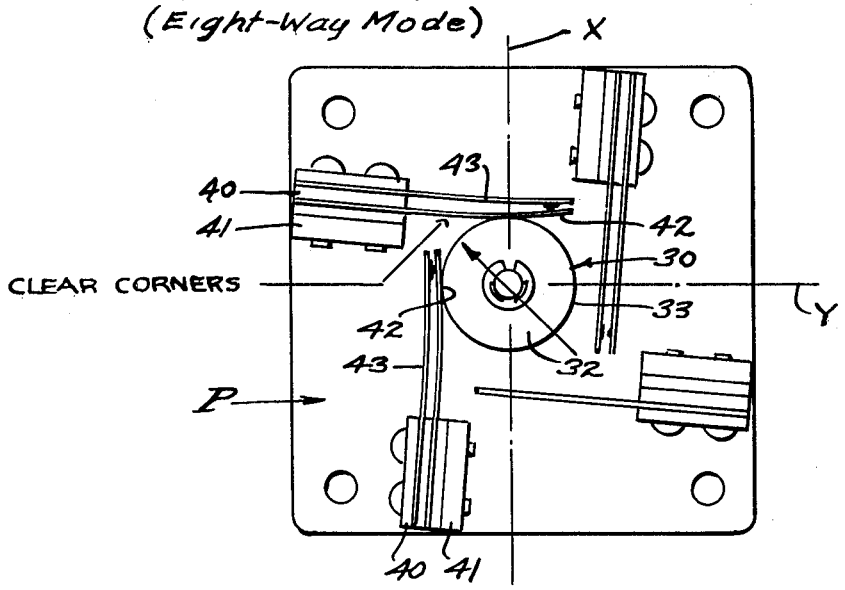
FIGS. 12 and 13 are bottom views similar to FIG. 2 showing the eight-way and four-way modes of operation respectively, FIG. 12 showing diagonal shifting of the cam into one of the four corners so as to actuate adjacent switches, and FIG. 13 showing diagonal shifting of the cam restricted from corner actuation of either of said adjacent switches.
Figure 13:
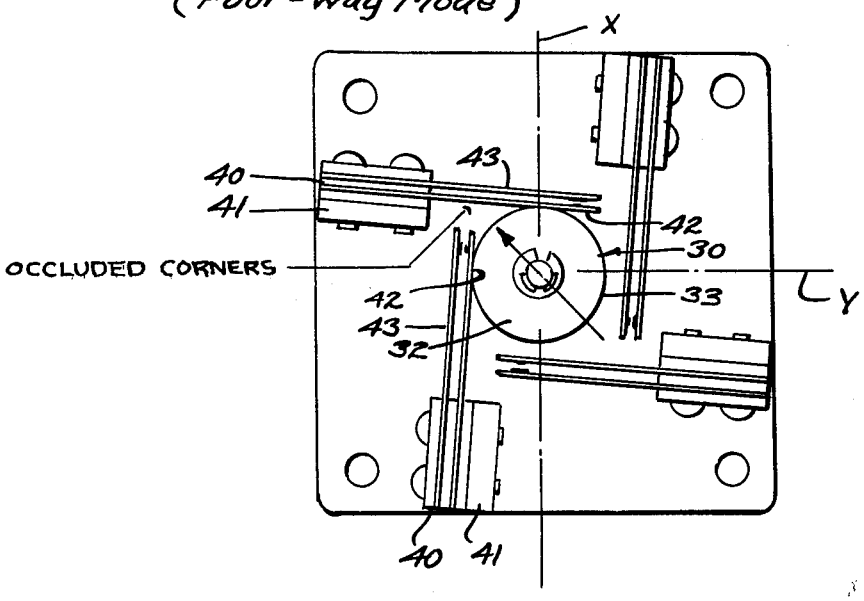

Switch construction can vary, and in FIGS. 1 and 2 are shown as conventional leaf switches with an outer leaf 43 spaced parallel to said inner leaf 42, and with contacts engageable when forced together by displacement of the cam engaging the inner leaf. In FIG. 11 there is a common contact band 44 carried by and surrounding the cam 30, with its periphery disposed to engage each complementary leaf 42' normally spaced therefrom as above described with respect to the inner leaves 42.

It is the actuation of at least one of four switches in a four-way mode, or additionally two adjacent corner related switches in an eight-way mode, with which this invention is particularly concerned, and to this end we have provided controlling gates G or G1 and G2. These gates preferably surround the joystick leg 20 in a horizontal plane overlying the motion restricting socket 10 and flange 11 combination hereinabove described, their purpose being to control the mode of switch operation. Alternately, these gates surround the joystick leg 21 in a horizontal plane underlying the mounting plate P, in which case the gates G or G1 and G2 are carried by the aforementioned housing (not shown). Characteristically, the gates G1 and G2 establish polygonal openings through which the leg 20 passes with limited motion, and unobviously the square opening configuration of gate G1 establishes an eight-way mode of operation, while the octagonal opening configuration resulting from selective positioning of gate G2 establishes a four-way mode. In practice, gate G1 is fixed while gate G2 is selectively adjusted into either one of two positions, and a feature is that the controlling opening through each gate G1 and G2 is a square opening complementary to the aforesaid square formed by the inner leaves 42 of the four switches, or equivalent contact positions, surrounding the switching cam 30.

The fulcrum of the joystick legs 20 and 21 occurs centrally on the plane of joinder between the conical portion 25 and cylinder portion 26 of flange 11, and this fulcrum lifts as the flange 11 is tilted. Referring now to FIGS. 1–4 of the drawings, there is a gate G having an opening of upwardly divergent conical interior configuration, overlying the socket 10, and stopping the leg 20 at uniform angular displacement regardless of which direction the joystick is manipulated. The leg 20 is stopped when its outer cylinder wall establishes line contact with the inner conical wall 46 of the gate G. The conical opening configuration of gate G is sufficient to allow depression of a leaf 42 on one switch when moved in alignment with either axis X or Y, and also to allow depression of adjacent right angularly related leaves 42 of two switches when moved diagonally with respect to axes X and Y, thereby establishing an eight-way mode of operation.

In accordance with this invention and referring to FIGS. 5 through 10 of the drawings, the gates G1 and G2 cooperate to establish either one of two selective modes of operation, four-way and eight-way. The gates are characterized by openings of like polygonal configuration, the gate G1 being fixedly positioned to overly the socket 10, and the gate G2 superimposed over the gate G1. In order to establish four-way or eight-way modes of operation, the gates G1 and G2 have openings of square configuration with the walls thereof flared upwardly at a divergent angle and each stopping the leg 20 at the same angular displacement along axes X and Y. The leg 20 is stopped along axes X and Y when its outer cylinder wall establishes line contact with the flat divergent inner walls 47 and 48 of gates G1 and G2. The flat sided opening configurations of gates G1 and G2 is sufficient to allow depression of a leaf 42 of one switch when moved in alignment with either axis X or Y, and also to allow depression of adjacent right angularly related leaves 42 of two switches when moved diagonally into a corner of said square opening configuration, thereby establishing an eight-way mode of operation.

The gate G2 is concentrically superimposed over the gate G1 with its inner walls 48 continuing in planar fashion from the walls 47 of gate G1, when in the eight-way mode. In accordance with this invention, the gate G2 is adapted to be rotatably adjusted to an angular displacement of 45°, whereby the corner portions of the square openings through gates G1 and G2 are occluded by the flat side walls thereof respectively. Accordingly, the composite effect is the establishment of an octagonal opening configuration (see FIG. 10). The opening of gate G1 remains fixedly oriented, however the inner walls 48 occlude each of the four corners of the opening through gate G1, thereby precluding diagonal actuation of two adjacent switches and thereby establishing a four-way mode of operation.

The change-over from mode to mode is by adjustment means rotatably positioning the gate G2 with respect to the fixedly positioned gate G1. In its preferred form this adjustment means is a plug and socket means involving keyed engagement of the two gates. As shown, the exterior of gate G1 is octagonal at 50 and the socket interior of gate G2 is of complementary form and/or octagonal to have two effective positions, straight through and occluded. Alternately, the plug and socket can be cylindrical with key and slot engagement for said two mode positions.

From the foregoing, it will be understood how the joystick of the present invention is carried by a mounting plate without yokes or pivot pins, and secured by a single retainer clip and the assembly held tight by means of a single compression spring. Movement of the joystick leg is restricted by means of a flange and socket and is effectively gimbaled thereby on X and Y axes. The diametric placement of switches along axes X and Y is conducive to four-way and eight-way modes of operation, and these two modes are selected by positioning adjustment gates and one of which occludes the operational corner portions of the other for this controlled effect.

Having described only the typical preferred forms and applications of our invention, we do not wish to be limited or restricted to the specific details herein set forth, but wish to reserve to ourselves any modifications or variations that may appear to those skilled in the art as set forth within the limits of the following claims.

We claim:

1. A joystick control for the selective actuation of diametrically opposed switches placed in at least one pair on a horizontal axis intersecting a centered vertical axis of the joystick, and including;

a mounting plate fixedly carrying said switches and having a vertical opening therethrough comprised of a stepped cylindrical bore with an upwardly faced planar shoulder for support of the joystick, the joystick having an upper leg of cylinder form extending upwardly from the opening in the mounting plate and to be tilted laterally and having a lower leg of cylinder form extending downwardly from the opening in the mounting plate and carrying a cam member at the plane of said hoizontal axes to engage and actuate said switches, a flange on and for mounting and restricting lateral movement oif the joystick and having a planar bottom face supportably engageable flat upon the upwardly faced shoulder in said mounting plate bore, a compression spring means yieldingly biased between the bottom of the mounting plate and an upwardly faced seat carried by the joystick to maintain a downwardly assembled normally upright and centered condition of the joystick.

2. The joystick control as set forth in claim 1, wherein the mounting plate bore has an inner portion of cylinder form adjacent said upwardly faced shoulder and has an upwardly divergent outer portion of conical form and the height of which permits tilting of the flange on the joystick, and wherein the flange on the joystick has a downwardly convergent inner portion of conical form operable within said inner portion of cylinder form of the mounting plate bore and has an outer portion of cylinder form operable within said outer portion of upwardly divergent conical form of the mounting plate bore, the said outer portions of the flange and mounting plate bore having line contact for stopped engagement restricting tilt.

3. The joystick control as set forth in claim 2, wherein the planes of joinder between the conical and cylindrical forms of the flange on the joystick and of the mounting plate bore are coplanar when said joystick is centered.

4. The joystick control as set forth in claim 1, wherein the compression spring means seats against a washer freely surrounding the lower leg of the joystick and slidable against the bottom of the mounting plate.

5. The joystick control as set forth in claim 1, wherein the joinder of the upper and lower legs of the joystick is defined by a downwardly faced step, and wherein the cam member is circular and slidable over the lower leg and engaged with and positioned by the step.

6. The joystick control as set forth in claim 1, wherein the mounting plate bore has an inner portion of cylinder form adjacent said upwardly faced shoulder and has an upwardly divergent outer portion of conical form and the height of which permits tilting of the flange on the joystick, wherein the flange on the joystick has a downwardly convergent inner portion of conical form operable within said inner portion of cylinder form of the mounting plate bore and has an outer portion of cylinder form operable within said outer portion of upwardly divergent conical form of the mounting plate bore, wherein the planes of joinder between the conical and cylindrical forms of the flange on the joystick and of the mounting plate bore are coplanar when said joystick is centered, the said outer portions of the flange and mounting plate bore having line contact for stopped engagement restricting tilt, wherein the compression spring means seats against a washer freely surrounding the lower leg of the joystick and slidable against the bottom of the mounting plate, wherein joinder of the upper and lower legs of the joystick is defined by a downwardly faced step, and wherein the cam member is circular and slidable over the lower leg and positioned by the step.

7. A joystick control for the selective actuation of two pairs of diametrically opposed switches placed in pairs on normally related and horizontal X and Y axes intersecting a centered vertical axis of the joystick, and including;

a mounting plate fixedly carrying said diametrically opposed switches and having a vertical opening therethrough comprised of a stepped cylindrical bore with an upwardly faced planar shoulder for support of the joystick, the joystick having an upper leg of cylinder form extending upwardly from the opening in the mounting plate and to be tilted laterally and having a lower leg extending downwardly from the opening in the mounting plate and carrying a cam member at the planes of said horizontal X and Y axes to engage and actuate said switches, a flange on and for mounting and restricting lateral movement of the joystick and having a planar bottom face supportably engageable flat upon the upwardly faced shoulder in said mounting plate bore, a compression spring means yieldingly biased between the bottom of the mounting plate and an upwardly faced seat carried by the joystick to maintain a downwardly assembled and normally upright and centered condition of the joystick, and a gate carried by the mounting plate concentric with the centered vertical axis of the joystick and having an opening therethrough to pass and engage a periphery of a leg of the joystick thereby restricting lateral tilting thereof.

8. The joystick control as set forth in claim 7, wherein the mounting plate bore has an inner portion of cylinder form adjacent said upwardly faced shoulder and has an upwardly divergent outer portion of conical form and the height of which permits tilting of the flange on the joystick, and wherein the flange on the joystick has a downwardly convergent inner portion of conical form operable within said inner portion of cylinder form of the mounting plate bore and has an outer portion of cylinder form operable within said outer portion of upwardly divergent conical form of the mounting plate bore, the said outer portions of the flange and mounting plate bore having line contact for stopped engagement restricting tilt when at least one of said switches is actuated.

9. The joystick control as set forth in claim 7, wherein each switch includes a leaf contact spaced from the cam member when it is centered and adapted to be actuated when depressably engaged thereby, actuable portions of said leaf contacts being disposed on said X and Y axes in right angular relation to each other forming a square configuration surrounding said cam member.

10. The joystick control as set forth in claim 7, wherein the mounting plate bore has an inner portion of cylinder form adjacent said upwardly faced shoulder and has an upwardly divergent outer portion of conical form and the height of which permits tilting of the flange on the joystick, wherein the flange on the joystick has a downwardly convergent inner portion of conical form operable within said inner portion of cylinder form of the mounting plate bore and has an outer portion of cylinder form operable within said outer portion of upwardly divergent conical form of the mounting plate bore, the said outer portions of the flange and mounting plate bore having line contact for stopped engagement restricting tilt when at least one of said switches is actuated, and wherein each switch includes a leaf contact spaced from the cam member when it is centered and adapted to be actuated when depressably engaged thereby, actuable portions of said leaf contact being disposed on said X and Y axes in right angular relation to each other forming a square configuration surrounding said cam member.

11. The joystick control as set forth in claim 7, wherein each switch includes parallel leaf contacts with an innermost contact spaced from the cam member when it is centered and adapted to be actuated when depressably engaged thereby, actuable portions of said innermost leaf contacts being disposed on said X and Y axes in right angular relation to each other forming a square configuration surrounding said cam member.

12. The joystick control as set forth in claim 7, wherein the mounting plate bore has an inner portion of cylinder form adjacent said upwardly faced shoulder and has an upwardly divergent outer portion of conical form and the height of which permits tilting of the flange on the joystick, wherein the flange on the joystick has a downwardly convergent inner portion of conical form operable within said inner portion of cylinder form of the mounting plate bore and has an outer portion of cylinder form operable within said outer portion of upwardly divergent conical form of the mounting plate bore, the said outer portions of the flange and mounting plate bore having line contact for stopped engagement restricting tilt when at least one of said switches is actuated, and wherein each switch includes parallel leaf contacts with an innermost contact spaced from the cam member when it is centered and adapted to be actuated when depressably engaged thereby, actuable portions of said innermost leaf contacts being disposed on said X and Y axes in right angular relation to each other forming a square configuration surrounding said cam member.

13. The joystick control as set forth in claim 7, wherein the first mentioned gate is square with two pairs of opposed faces thereof normal to the axes X and Y, and wherein a rotatable second gate is coaxial with the first mentioned gate and with two pairs of opposed faces thereof normal to the axes X and Y when aligned therewith to continue from the faces of the first mentioned gate for eight-way operation of the upper leg of the joystick into engagement with each of four faces for actuation of individual switches and diagonally into engagement with each pair of adjacent corner faces for actuation of pairs of adjacent switches, the second gate being selectively positionable by means rotatably placing it at a 45° angular displacement whereby the faces of the second mentioned gate opening occlude the corner areas of the first mentioned gate opening thereby controlling the lateral displacement of the joystick to preclude diagonal actuation of pairs of adjacent switches so that four-way operation is achieved.

14. The joystick control as set forth in claim 8, wherein the first mentioned gate is square with two pairs of opposed faces thereof normal to the axes X and Y, and wherein a rotatable second gate is coaxial with the first mentioned gate and with two pairs of opposed faces thereof normal to the axes X and Y when aligned therewith to continue from the faces of the first mentioned gate for eight-way operation of the upper leg of the joystick into engagement with each of four faces for actuation of individual switches and diagonally into engagement with each pair of adjacent corner faces for actuation of pairs of adjacent switches, the second gate being selectively positionable by means rotatably placing it at a 45° angular displacement whereby the faces of the second mentioned gate opening occlude the corner areas of the first mentioned gate opening thereby controlling the lateral displacement of the joystick to preclude diagonal actuation of pairs of adjacent switches so that four-way operation is achieved.

15. The joystick control as set forth in claim 9, wherein the first mentioned gate is square with two pairs of opposed faces thereof normal to the axes X and Y, and wherein a rotatable second gate is coaxial with the first mentioned gate and with two pairs of opposed faces thereof normal to the axes X and Y when aligned therewith to continue from the faces of the first mentioned gate for eight-way operation of the upper leg of the joystick into engagement with each of four faces for actuation of individual switches and diagonally into engagement with each pair of adjacent corner faces for actuation of pairs of adjacent switches, the second gate being selectively positionable by means rotatably placing it at a 45° angular displacement whereby the faces of the second mentioned gate opening occlude the corner areas of the first mentioned gate opening thereby controlling the lateral displacement of the joystick to preclude diagonal actuation of pairs of adjacent switches so that four-way operation is achieved.

16. The joystick control as set forth in claim 10, wherein the first mentioned gate is square with two pairs of opposed faces thereof normal to the axes X and Y, and wherein a rotatable second gate is coaxial with the first mentioned gate and with two pairs of opposed faces thereof normal to the axes X and Y when aligned therewith to continue from the faces of the first mentioned gate for eight-way operation of the upper leg of the joystick into engagement with each of four faces for actuation of individual switches and diagonally into engagement with each pair of adjacent corner faces for actuation of pairs of adjacent switches, the second gate being selectively positionable by means rotatably placing it at a 45° angular displacement whereby the faces of the second mentioned gate opening occlude the corner areas of the first mentioned gate opening thereby controlling the lateral displacement of the joystick to preclude diagonal actuation of pairs of adjacent switches so that four-way operation is achieved.

17. The joystick control as set forth in claim 11, wherein the first mentioned gate is square with two pairs of opposed faces thereof normal to the axes X and Y, and wherein a rotatable second gate is coaxial with the first mentioned gate and with two pairs of opposed faces thereof normal to the axes X and Y when aligned therewith to continue from the faces of the first mentioned gate for eight-way operation of the upper leg of the joystick into engagement with each of four faces for actuation of individual switches and diagonally into engagement with each pair of adjacent corner faces for actuation of pairs of adjacent switches, the second gate being selectively positionable by means rotatably placing it at a 45° angular displacement whereby the faces of the second mentioned gate opening occlude the corner areas of the first mentioned gate opening thereby controlling the lateral displacement of the joystick to preclude diagonal actuation of pairs of adjacent switches so that four-way operation is achieved.

18. The joystick control as set forth in claim 12, wherein the first mentioned gate is square with two pairs of opposed faces thereof normal to the axes X and Y, and wherein a rotatable second gate is coaxial with the first mentioned gate and with two pairs of opposed faces thereof normal to the axes X and Y when aligned therewith to continue from the faces of the first mentioned gate for eight-way operation of the upper leg of the joystick into engagement with each of four faces for actuation of individual switches and diagonally into engagement with each pair of adjacent corner faces for actuation of pairs of adjacent switches, the second gate being selectively positionable by means rotatably placing it at a 45° angular displacement whereby the faces of the second mentioned aate opening occlude the corner areas of the first mentioned gate opening thereby controlling the lateral displacement of the joystick to preclude diagonal actuation of pairs of adjacent switches so that four-way operation is achieved.

19. The joystick control as set forth in claim 7, wherein the first mentioned gate is square with two pairs of opposed faces thereof normal to the axes X and Y, and wherein a rotatable second gate is coaxial with the first mentioned gate and with two pairs of opposed faces thereof normal to the axes X and Y when aligned therewith to continue from the faces of the first mentioned gate for eight-way operation of the upper leg of the joystick into engagement with each of four faces for actuation of individual switches and diagonally into engagement with each pair of adjacent corner faces for actuation of pairs of adjacent switches, the pairs of opposed faces of the first and second mentioned gates continuing one from the other and having line contact with the periphery of the upper leg of the joystick for stopped engagement restricting tilt, the second gate being selectively positionable by means rotatably placing it at a 45° angular displacement whereby the faces of the second mentioned gate opening occlude the corner areas of the first mentioned gate opening thereby controlling the lateral displacement of the joystick to preclude diagonal actuation of pairs of adjacent switches so that four-way operation is achieved.

20. The joystick control as set forth in claim 8, wherein the first mentioned gate is square with two pairs of opposed faces thereof normal to the axes X and Y, and wherein a rotatable second gate is coaxial with the first mentioned gate and with two pairs of opposed faces thereof normal to the axes X and Y when aligned therewith to continue from the faces of the first mentioned gate for eight-way operation of the upper leg of the joystick into engagement with each of four faces for actuation of individual switches and diagonally into engagement with each pair of adjacent corner faces for actuation of pairs of adjacent switches, the pairs of opposed faces of the first and second mentioned gates continuing one from the other and having line contact with the periphery of the upper leg of the joystick for stopped engagement restricting tilt, the second gate being selectively positionable by means rotatably placing it at a 45° angular displacement whereby the faces of the second mentioned gate opening occlude the corner areas of the first mentioned gate opening thereby controlling the lateral displacement of the joystick to preclude diagonal actuation of pairs of adjacent switches so that four-way operation is achieved.

21. The joystick control as set forth in claim 9, wherein the first mentioned gate is square with two pairs of opposed faces thereof normal to the axes X and Y, and wherein a rotatable second gate is coaxial with the first mentioned gate and with two pairs of opposed faces thereof normal to the axes X and Y when aligned therewith to continue from the faces of the first mentioned gate for eight-way operation of the upper leg of the joystick into engagement with each of four faces for actuation of individual switches and diagonally into engagement with each pair of adjacent corner faces for actuation of pairs of adjacent switches, the pairs of opposed faces of the first and second mentioned gates continuing one from the other and having line contact with the periphery of the upper leg of the joystick for stopped engagement restricting tilt, the second gate being selectively positionable by means rotatably placing it at a 45° angular displacement whereby the faces of the second mentioned gate opening occlude the corner areas of the first mentioned gate opening thereby controlling the lateral displacement of the joystick to preclude diagonal actuation of pairs of adjacent switches so that four-way operation is achieved.

22. The joystick control as set forth in claim 10, wherein the first mentioned gate is square with two pairs of opposed faces thereof normal to the axes X and Y, and wherein a rotatable second gate is coaxial with the first mentioned gate and with two pairs of opposed faces thereof normal to the axes X and Y when aligned therewith to continue from the faces of the first mentioned gate for eight-way operation of the upper leg of the joystick into engagement with each of four faces for actuation of individual switches and diagonally into engagement with each pair of adjacent corner faces for actuation of pairs of adjacent switches, the pairs of opposed faces of the first and second mentioned gates continuing one from the other and having line contact with the periphery of the upper leg of the joystick for stopped engagement restricting tilt, the second gate being selectively positionable by means rotatably placing it at a 45° angular displacement whereby the faces of the second mentioned gate opening occlude the corner areas of the first mentioned gate opening thereby controlling the lateral displacement of the joystick to preclude diagonal actuation of pairs of adjacent switches so that four-way operation is achieved.

23. The joystick control as set forth in claim 11, wherein the first mentioned gate is square with two pairs of opposed faces thereof normal to the axes X and Y, and wherein a rotatable second gate is coaxial with the first mentioned gate and with two pairs of opposed faces thereof normal to the axes X and Y when aligned therewith to continue from the faces of the first mentioned gate for eight-way operation of the upper leg of the joystick into engagement with each of four faces for actuation of individual switches and diagonally into engagement with each pair of adjacent corner faces for actuation of pairs of adjacent switches, the pairs of opposed faces of the first and second mentioned gates continuing one from the other and having line contact with the periphery of the upper leg of the joystick for stopped engagement restricting tilt, the second gate being selectively positionable by means rotatably placing it at a 45° angular displacement whereby the faces of the second mentioned gate opening occlude the corner areas of the first mentioned gate opening thereby controlling the lateral displacement of the joystick to preclude diagonal actuation of pairs of adjacent switches so that four-way operation is achieved.

24. The joystick control as set forth in claim 12, wherein the first mentioned gate is square with two pairs of opposed faces thereof normal to the axes X and Y, and wherein a rotatable second gate is coaxial with the first mentioned gate and with two pairs of opposed faces thereof normal to the axes X and Y when aligned therewith to continue from the faces of the first mentioned gate for eight-way operation of the upper leg of the joystick into engagement with each of four faces for actuation of individual switches and diagonally into engagement with each pair of adjacent corner faces for actuation of pairs of adjacent switches, the pairs of opposed faces of the first and second mentioned gates continuing one from the other and having line contact with the periphery of the upper leg of the joystick for stopped engagement restricting tilt, the second gate being selectively positionable by means rotatably placing it at a 45° angular displacement whereby the faces of the second mentioned gate opening occlude the corner areas of the first mentioned gate opening thereby controlling the lateral displacement of the joystick to preclude diagonal actuation of pairs of adjacent switches so that four-way operation is achieved.

25. The joystick control as set forth in claim 7, wherein a common contact band is carried by and surrounds the cam member, and wherein each switch includes a leaf contact spaced from the contact band when the cam member is centered and adapted to be contacted when depressably engaged; actuable portions of said leaf contacts being disposed on said X and Y axes in right angular relation to each other forming a square configuration surrounding said cam member and contact band carried thereby.

* * * * *